US011616315B2

(12) United States Patent
Mousa et al.

(10) Patent No.: US 11,616,315 B2
(45) Date of Patent: Mar. 28, 2023

(54) SYSTEMS, METHODS, AND DEVICES FOR NETWORKING CABLE ASSEMBLIES

(71) Applicant: MELLANOX TECHNOLOGIES, LTD., Yokneam (IL)

(72) Inventors: Jamal Mousa, Haifa (IL); Nimer Khazen, Yokneam (IL); Uri Goffer-Dor, Aloney Aba (IL); Dmitry Fliter, Kiryat-Yam (IL); David Fischer, Pardes Hanna-Karkur (IL); Alona Najmanovich, Yokneam (IL); Tarek Hathoot, Yokneam (IL); Dor Dadon, Yorkneam (IL)

(73) Assignee: MELLANOX TECHNOLOGIES, LTD., Yokneam (IL)

( * ) Notice: Subject to any disclaimer, the term of this patent is extended or adjusted under 35 U.S.C. 154(b) by 0 days.

(21) Appl. No.: 17/308,807

(22) Filed: May 5, 2021

(65) Prior Publication Data

US 2022/0360007 A1 Nov. 10, 2022

(51) Int. Cl.

| | |
|---|---|
| ***H01R 12/75*** | (2011.01) |
| ***H01R 12/72*** | (2011.01) |
| ***H01R 24/64*** | (2011.01) |
| *H01R 107/00* | (2006.01) |

(52) U.S. Cl.

CPC ..... *H01R 12/75* (2013.01); *H01R 12/721* (2013.01); *H01R 24/64* (2013.01); *H01R 2107/00* (2013.01)

(58) Field of Classification Search

CPC ..... H01R 13/6658; H01R 24/64; H01R 2107/00; H01R 12/53; H01R 12/54; H01R 12/75; H01R 12/62; H01R 12/79; H01R 12/721; H05K 3/328; H05K 3/34; H05K 2201/10356

See application file for complete search history.

(56) References Cited

U.S. PATENT DOCUMENTS

| | | | | |
|---|---|---|---|---|
| 8,840,432 | B2 * | 9/2014 | Alden, III | H01R 9/0515 439/607.46 |
| 9,373,915 | B1 * | 6/2016 | Schulz | H01R 13/6461 |
| 9,437,949 | B2 * | 9/2016 | Behziz | H01R 13/6588 |
| 9,490,588 | B2 * | 11/2016 | Keyser | H01R 13/6595 |
| 10,283,885 | B2 * | 5/2019 | Little | H01R 12/716 |
| 10,314,162 | B1 * | 6/2019 | Oz | H05K 3/34 |
| 10,498,085 | B2 * | 12/2019 | Dill, III | H01R 13/629 |
| 10,535,956 | B2 * | 1/2020 | Henry | H01R 12/62 |
| 10,777,951 | B2 * | 9/2020 | Wu | H01R 12/53 |
| 10,916,870 | B2 * | 2/2021 | Wu | H01R 13/6275 |
| 10,916,877 | B1 * | 2/2021 | Khazen | H01R 13/65915 |
| 10,925,159 | B2 * | 2/2021 | Chen | H05K 3/3405 |
| 10,957,997 | B2 * | 3/2021 | Qiao | H01R 12/50 |
| 11,025,013 | B2 * | 6/2021 | Little | H01R 12/72 |
| 11,228,123 | B2 * | 1/2022 | Ayzenberg | H01R 13/6592 |

(Continued)

*Primary Examiner* — Marcus E Harcum

(74) *Attorney, Agent, or Firm* — Sheridan Ross P.C.

(57) ABSTRACT

A connector for a networking cable assembly includes a substrate, a first set of contacts on a first surface of the substrate that electrically connect to leads of a first cable, and a second set of contacts on the first surface of the substrate that electrically connect to leads of a second cable. The first set of contacts are spaced apart from the second set of contacts in a first direction by an amount that enables the second cable to be stacked on the first cable and passed over the first set of contacts to electrically connect to the leads of the second cable.

20 Claims, 12 Drawing Sheets

(56) References Cited

U.S. PATENT DOCUMENTS

| | | | | |
|---|---|---|---|---|
| 11,245,210 | B2 * | 2/2022 | Ratkovic | H01R 12/62 |
| 11,283,218 | B2 * | 3/2022 | Qiao | H01R 13/6592 |
| 2006/0234556 | A1 * | 10/2006 | Wu | H01R 12/721 439/607.05 |
| 2007/0155217 | A1 * | 7/2007 | Wu | H01R 13/512 439/353 |
| 2011/0306244 | A1 * | 12/2011 | Zhang | H01R 13/65914 439/624 |
| 2013/0005178 | A1 * | 1/2013 | Straka | H01R 13/65914 439/497 |
| 2014/0154895 | A1 * | 6/2014 | Poulsen | H01R 13/6586 439/607.38 |
| 2014/0349496 | A1 * | 11/2014 | Zhu | H05K 1/0219 439/108 |
| 2018/0366852 | A1 * | 12/2018 | Yang | H01R 12/775 |
| 2019/0140374 | A1 * | 5/2019 | Wu | H01R 12/53 |
| 2019/0260165 | A1 * | 8/2019 | Below | H01R 12/596 |
| 2019/0356086 | A1 * | 11/2019 | Smith | H01R 13/5808 |
| 2020/0036117 | A1 * | 1/2020 | Little | H01R 12/53 |
| 2020/0194911 | A1 * | 6/2020 | Ayzenberg | H01R 13/6594 |
| 2022/0102919 | A1 * | 3/2022 | Doye | G02B 6/4261 |
| 2022/0158390 | A1 * | 5/2022 | Lee | H01R 13/6594 |
| 2022/0159836 | A1 * | 5/2022 | Neu | H01R 13/6658 |

* cited by examiner

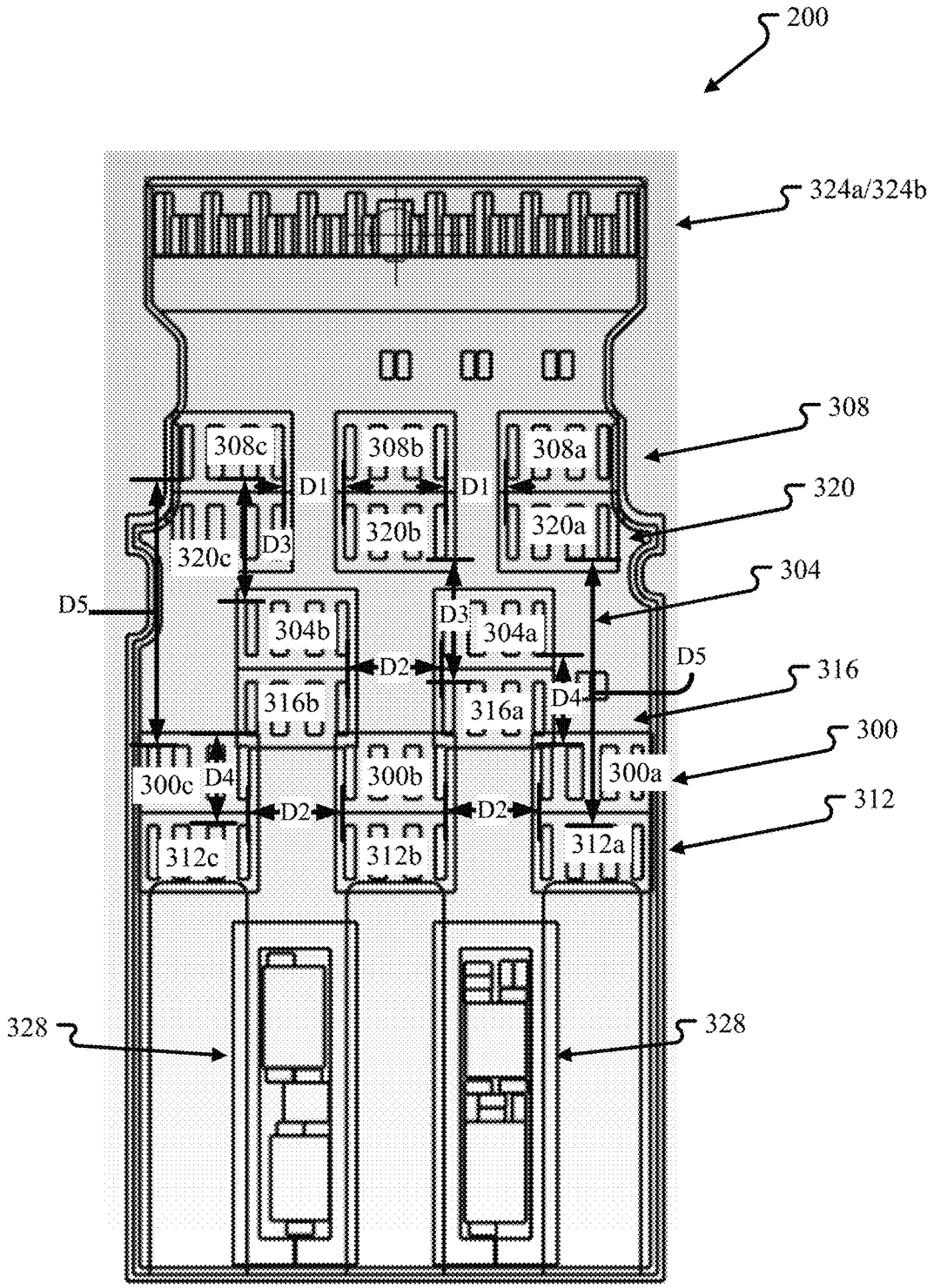
*Fig. 3D*
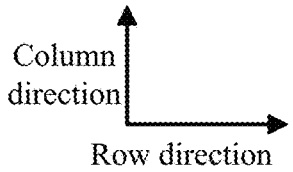

SYSTEMS, METHODS, AND DEVICES FOR NETWORKING CABLE ASSEMBLIES

FIELD OF THE DISCLOSURE

The present disclosure is generally directed to systems, devices, and methods for networking cable assemblies.

BACKGROUND

Datacenters are the storage and data processing hubs of the Internet. Cable assemblies are used to interconnect network devices and/or network switches within a datacenter to enable highspeed communication between the network switches.

BRIEF SUMMARY

In an illustrative embodiment, a connector for a networking cable assembly includes a substrate, a first set of contacts on a first surface of the substrate and that electrically connect to leads of a first cable, and a second set of contacts on the first surface of the substrate and that electrically connect to leads of a second cable. The first set of contacts is spaced apart from the second set of contacts in a first direction by an amount that enables the second cable to be stacked on the first cable and passed over the first set of contacts to electrically connect to the leads of the second cable.

In an illustrative embodiment, a printed circuit board (PCB) for a networking cable assembly includes a first group of contacts on a first surface of the PCB, and the first group of contacts are aligned with one another in a first direction. The PCB includes a second group of contacts on the first surface of the PCB, and the second group of contacts are aligned with one another in the first direction and spaced apart from the first group of contacts in a second direction substantially perpendicular to the first direction. The PCB includes a third group of contacts on the first surface of the PCB, and the third group of contacts are aligned with one another and spaced apart from the second group of contacts in the second direction.

In an illustrative embodiment, a networking cable assembly includes a printed circuit board (PCB) including a first set of contacts aligned with one another in a first direction and a second set of contacts that are aligned with one another in the first direction and spaced apart from the first set of contacts in a second direction substantially perpendicular to the first direction. The networking cable assembly includes a first cable including leads electrically connected to the first set of contacts and a second cable stacked on the first cable and passing over the first set of contacts to electrically connect leads of the second cable to the second set of contacts. The networking cable assembly includes a housing that houses the PCB.

Additional features and advantages are described herein and will be apparent from the following Description and the figures.

BRIEF DESCRIPTION OF THE SEVERAL VIEWS OF THE DRAWINGS

FIGS. 3A to 3D illustrate various details of a substrate from FIG. 2 according to at least one example embodiment;

DETAILED DESCRIPTION

Figure 1:
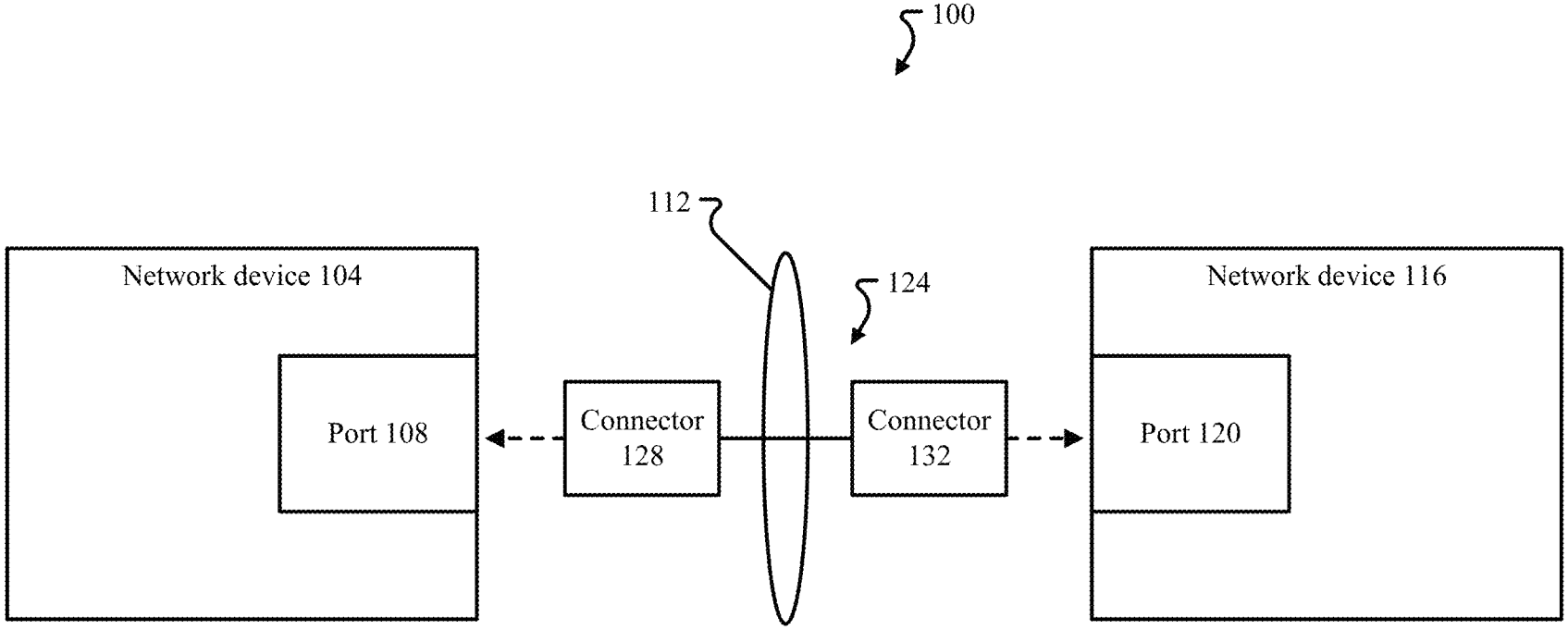
FIG. 1 illustrates a system according to at least one example embodiment.

The ensuing description provides embodiments only, and is not intended to limit the scope, applicability, or configuration of the claims. Rather, the ensuing description will provide those skilled in the art with an enabling description for implementing the described embodiments. It being understood that various changes may be made in the function and arrangement of elements without departing from the spirit and scope of the appended claims.

It will be appreciated from the following description, and for reasons of computational efficiency, that the components of the system can be arranged at any appropriate location within a distributed network of components without impacting the operation of the system.

Furthermore, it should be appreciated that the various links connecting the elements can be wired, traces, or wireless links, or any appropriate combination thereof, or any other appropriate known or later developed element(s) that is capable of supplying and/or communicating data to and from the connected elements. Transmission media used as links, for example, can be any appropriate carrier for electrical signals, including coaxial cables, copper wire and fiber optics, electrical traces on a PCB, or the like.

As used herein, the phrases "at least one," "one or more," "or," and "and/or" are open-ended expressions that are both conjunctive and disjunctive in operation. For example, each of the expressions "at least one of A, B and C," "at least one of A, B, or C," "one or more of A, B, and C," "one or more of A, B, or C," "A, B, and/or C," and "A, B, or C" means A alone, B alone, C alone, A and B together, A and C together, B and C together, or A, B and C together.

The terms "determine," "calculate," and "compute," and variations thereof, as used herein, are used interchangeably and include any appropriate type of methodology, process, operation, or technique.

Various aspects of the present disclosure will be described herein with reference to drawings that may be schematic illustrations of idealized configurations.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and this disclosure.

As used herein, the singular forms "a," "an," and "the" are intended to include the plural forms as well, unless the context clearly indicates otherwise. It will be further understood that the terms "include," "including," "includes," "comprise," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. The term "and/or" includes any and all combinations of one or more of the associated listed items.

Related art assemblies suffer from higher than desired cross talk between lanes which affects the signal integrity. Inventive concepts relate to an arrangement of soldering pad islands on a PCB and/or an arrangement of cables soldered to the pad islands. In particular, inventive concepts relate to an arrangement of the soldering pads that enables improved signal integrity. For example, a cable assembly according to inventive concepts achieves end to end loss uniformity between all lanes in a copper cable while reducing crosstalk between lanes.

In order to address these and other problems, inventive concepts propose an arrangement of rows of soldering pad islands (3×2×3 islands) that allows cable routing between islands, which achieves shorter trace lengths for both PCB component side and PCB print side (i.e., PCB top and bottom). The solution proposed by inventive concepts may optimize pad spacing for crosstalk mitigation between cables. Wires or cables passing between the gaps of contacts on the PCB may contribute to crosstalk reduction. Inventive concepts further enable stacking two wires one on top of the other, while using three soldering rows. A pitch between the rows may be optimized for both performance and ease of process.

FIG. 1 illustrates a system 100 according to at least one example embodiment. The system 100 includes a network device 104, a communication network 112, a network device 116, and a cable assembly 124. In at least one example embodiment, network devices 104 and 116 may correspond a network switch (e.g., an Ethernet switch), a network interface controller (NIC), and/or any other suitable device used to exchange data over communication network 112. Each network device 104 and 116 may be connected to one or more of Personal Computer (PC), a laptop, a tablet, a smartphone, a server, a collection of servers, or the like.

Examples of the communication network 112 that may be used to connect the network devices 104 and 116 include an Internet Protocol (IP) network, an Ethernet network, an InfiniBand (IB) network, a Fibre Channel network, the Internet, a cellular communication network, a wireless communication network, combinations thereof (e.g., Fibre Channel over Ethernet), variants thereof, and/or the like.

The network device 104 includes a port 108 while the network device 116 includes a port 120. Ports 108 and 120 may correspond to physical ports or connectors of the network devices 104 and 108 communicatively coupled to one another with the cable assembly 124. The network devices 104 and 116 may exchange data over the cable assembly 124 when the connectors 128 and 132 are connected to ports 108 and 120, respectively. The ports 108 and 120, the cable assembly 124 and connectors 128 and 132 may adhere any suitable form factor for the system 100, such as small form factor pluggable (SFP), SFP+, quad SFP (QSFP), QSFP+, QSFP-double density (QSFP-DD), octal SFP (OSFP), and/or the like. The cable assembly 124 may include one or more active and/or passive cables for carrying data. The cable assembly 124 may comprise one or more copper cables, one or more fiber optic cables, and/or any other suitable cable for transmitting data. In a scenario where the cable assembly 124 includes fiber optic cables, the connectors 128 and 132 may include optical transceivers that convert electrical signals into optical signals and optical signals into electrical signals. In one non-limiting example, the cable assembly 124 comprises a direct attached copper (DAC) cable assembly with OSFP connectors 128 and 132. Details of the cable assembly 124 are discussed in more detail below with reference to the figures.

Although not explicitly illustrated, it should be appreciated that the network device 104, the network device 116, and/or the cable assembly 124 may include processing circuitry and/or memory for carrying out computing tasks, for example, tasks associated with controlling the flow of data over the communication network 112. The processing circuitry may comprise software, hardware, or a combination thereof. For example, the processing circuitry may include a memory including executable instructions and a processor (e.g., a microprocessor) that executes the instructions on the memory. The memory may correspond to any suitable type of memory device or collection of memory devices configured to store instructions. Non-limiting examples of suitable memory devices that may be used include Flash memory, Random Access Memory (RAM), Read Only Memory (ROM), variants thereof, combinations thereof, or the like. In some embodiments, the memory and processor may be integrated into a common device (e.g., a microprocessor may include integrated memory). Additionally or alternatively, the processing circuitry may comprise hardware, such as an application specific integrated circuit (ASIC). Other non-limiting examples of the processing circuitry include an Integrated Circuit (IC) chip, a Central Processing Unit (CPU), a General Processing Unit (GPU), a microprocessor, a Field Programmable Gate Array (FPGA), a collection of logic gates or transistors, resistors, capacitors, inductors, diodes, or the like. Some or all of the processing circuitry may be provided on a Printed Circuit Board (PCB) or collection of PCBs. It should be appreciated that any appropriate type of electrical component or collection of electrical components may be suitable for inclusion in the processing circuitry.

In addition, although not explicitly shown, it should be appreciated that the network devices 104 and 116 and/or the cable assembly 124 may include one or more other communication interfaces and/or circuitry for facilitating wired and/or wireless communication between one another and/or other unillustrated elements of the system 100. For example, the cable assembly 124 may include circuitry associated with re-driving and/or re-timing the data sent and/or received over the communication network 112. Non-limiting examples of suitable re-timing and/or re-driving circuitry that may be used include Clock Data Recovery (CDR) circuitry and/or Linear Driver (LD) circuitry.

Figure 2:
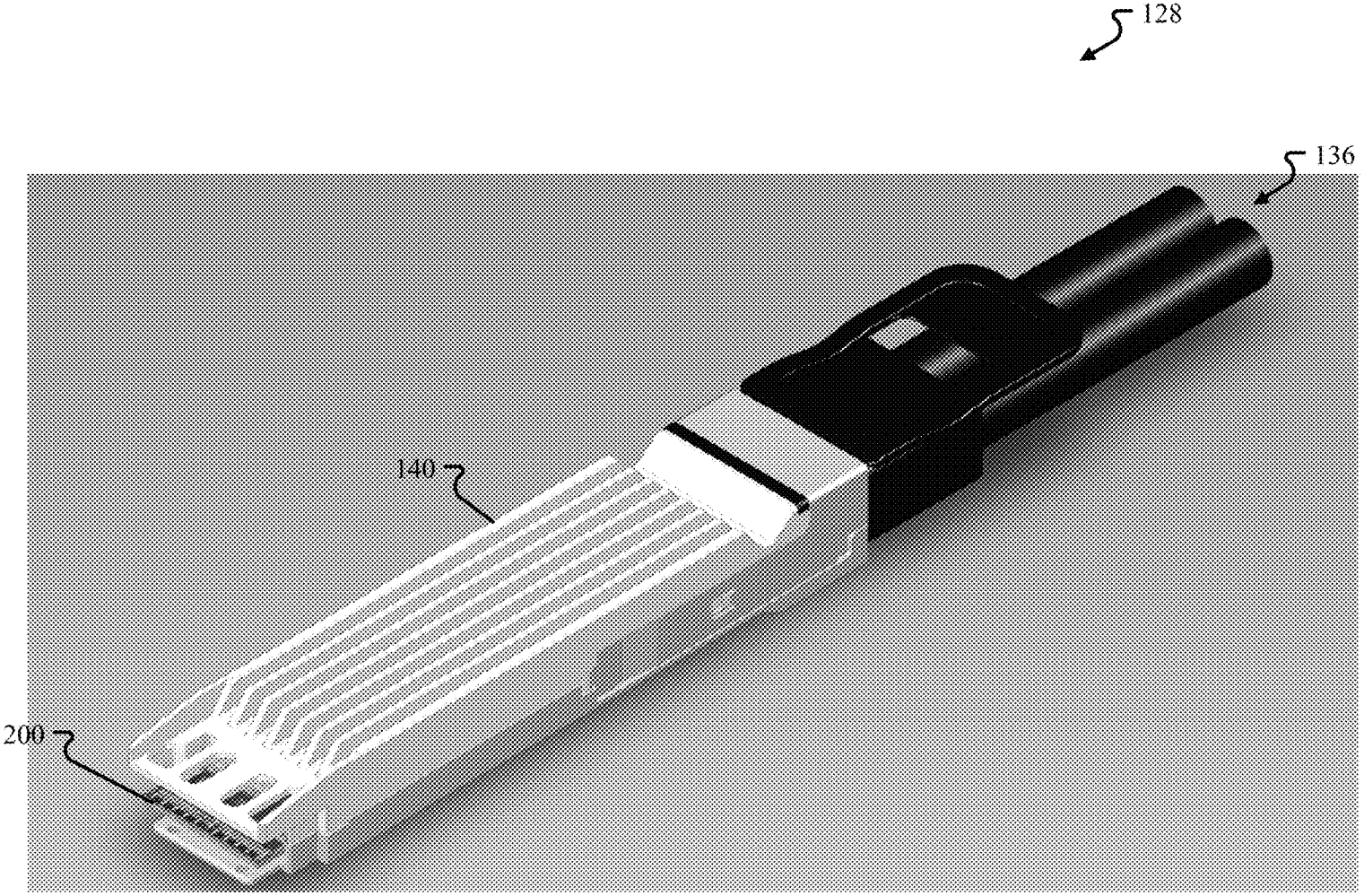
FIG. 2 illustrates an example structure for a connector of a cable assembly according to at least one example embodiment.

FIG. 2 illustrates an example structure for a connector of a cable assembly according to at least one example embodiment. FIG. 2 is shown and described with reference to connector 128 but the substantially same structure may be applied to the connector 132. The connector 128 may include an input for main cables 136 of the cable assembly 124. FIG. 2 illustrates a pair of main cables 136. Both main cables 136 are configured for transporting signals (e.g., optical or electrical data signals). For example, each main cable 136 may include a plurality of smaller cables comprising metal wires and/or optical fibers for carrying signals. A number and configuration of the wires and/or optical fibers in each smaller cable may vary depending upon the form factor being used for the cable assembly 124. For example, FIG. 2 illustrates a connector 128 for a DAC cable assembly 124 that conforms to OSFP standards. In this specific example, as shown and described in more detail below, each main cable 136 may include eight smaller cables with each smaller cable including four wires (e.g., copper wires).

The connector 128 may include a housing 140 that houses substrate 200 to which leads of each cable are attached (e.g., the leads are soldered to the contacts described below). The housing 140 may conform to size standards of the form factor being used for the cable assembly 124, in this case, OSFP standards for a DAC cable assembly 124. The substrate 200 may comprise a printed circuit board (PCB) or other suitable substrate for accommodating the form factor of the cable assembly 124.

Figure 5:
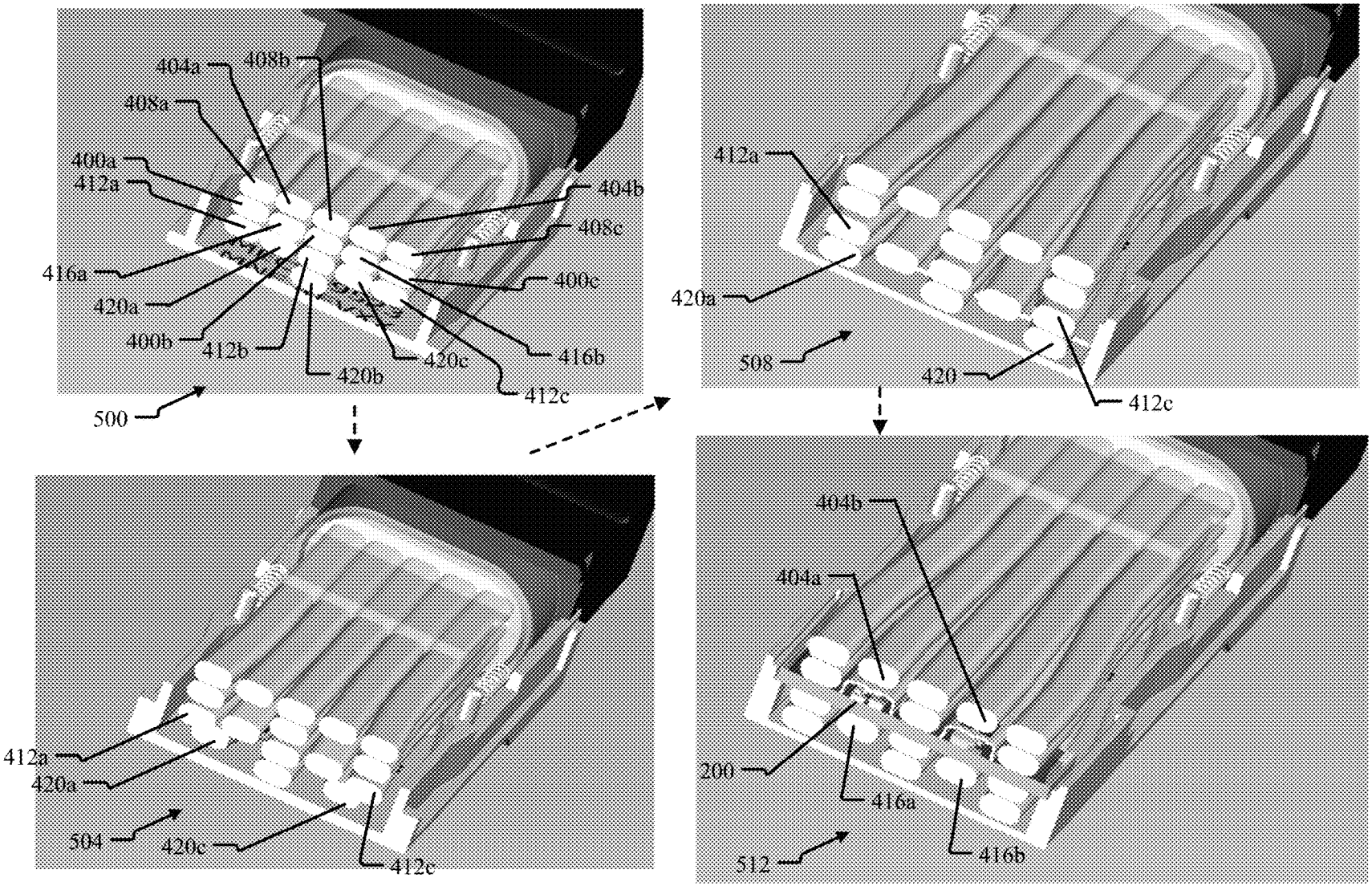
FIG. 5 illustrates various cross-sectional views to show how cables of a cable assembly are routed within a connector according to at least one example embodiment.
Figure 6:
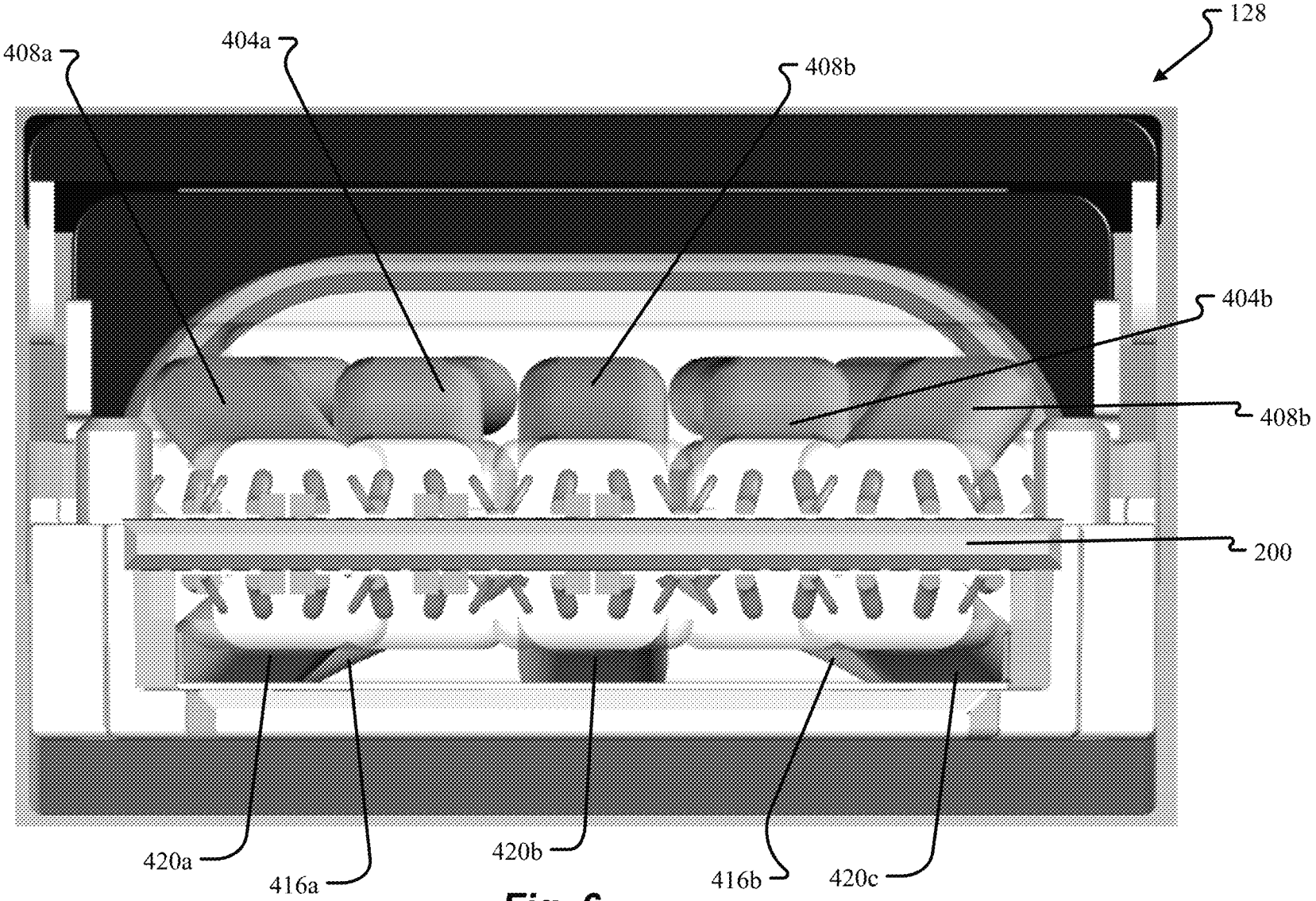
FIG. 6 illustrates an end view a connector from FIG. 2 according to at least one example embodiment.

Example embodiments will now be discussed with reference to FIGS. 3A to 6. FIGS. 3A to 3D illustrate various details of the substrate 200 from FIG. 2, FIGS. 4A to 4D illustrate various top and bottom views of the connector from FIG. 2 to show an arrangement of cables of the cable assembly 124 that connect to the substrate 200, FIG. 5 illustrates various cross-sectional views to show how cables of the cable assembly 124 are routed within the connector of FIG. 2, and FIG. 6 illustrates an end view of cables of the cable assembly 124.

Figure 3A:
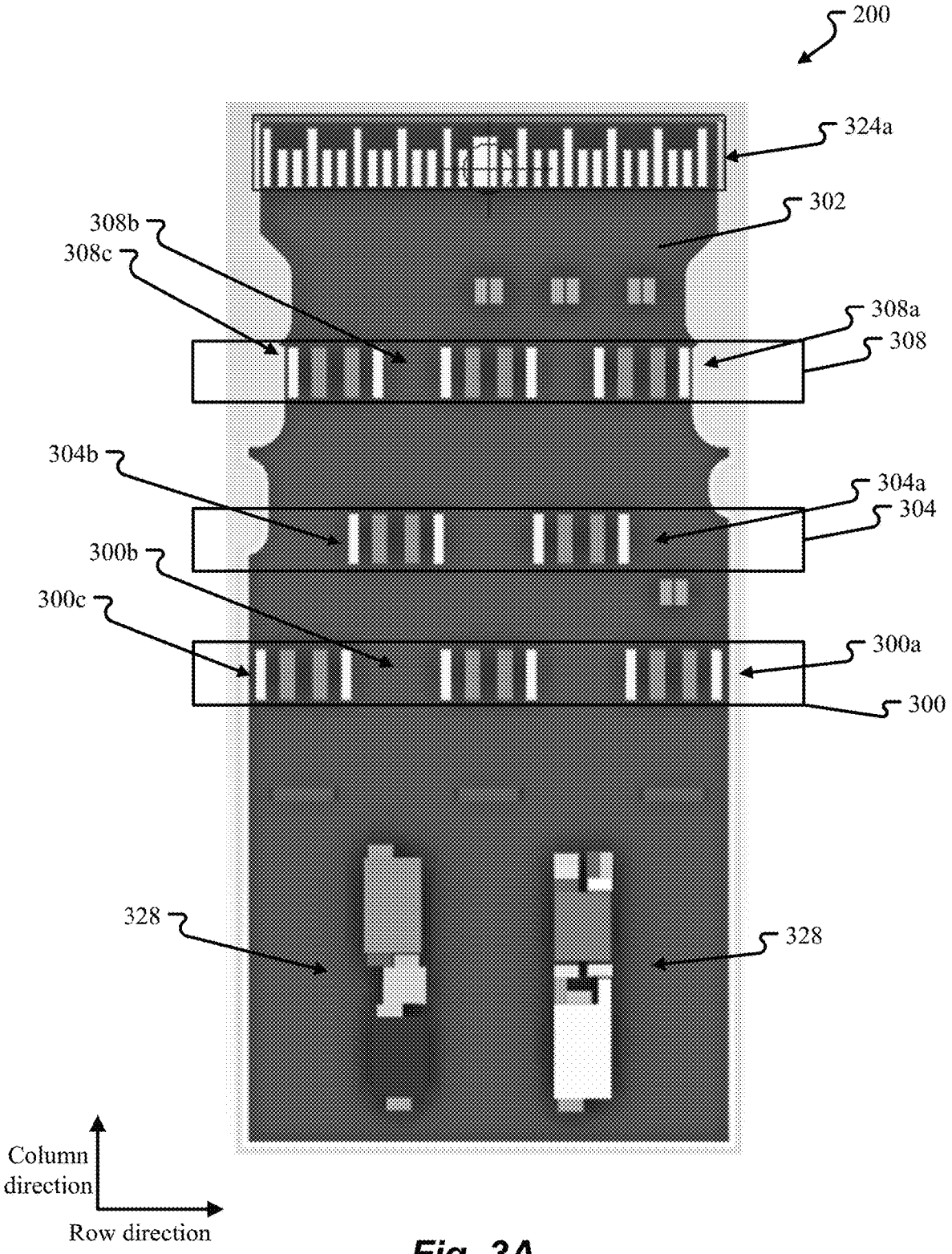

FIG. 3A illustrates a surface 302 of the substrate 200. The surface 302 includes groups of contacts 300, 304, and 308. Each group of contacts 300, 304, and 308 may include individual sets of contacts aligned with one another in a first direction (e.g., a row direction). For example, the group of contacts 300 is a row of contacts that includes a set of contacts 300*a*, a set of contacts 300*b*, and a set of contacts 300*c*. The group of contacts 304 is a row of contacts that includes a set of contacts 304*a* and a set of contacts 304*b*. The group of contacts 308 is a row of contacts that includes a set of contacts 308*a*, a set of contacts 308*b*, and a set of contacts 308*c*. Each set of contacts in each group of contacts may include a same number of contacts. In the example of FIG. 3A, each set of contacts includes four contacts. However, a number of contacts in each set of contacts may vary according to design preferences (e.g., according to the form factor for the cable assembly 124). As shown and described in more detail below, the group of contacts 300 and the group of contacts 308 are spaced apart from one another in a second direction (e.g., a column direction) that is substantially perpendicular to the first direction by an amount that allows cables connected to the group of contacts 308 to be stacked on the cables connected to the group of contacts 300.

Each contact in the groups of contacts 300, 304, and 308 may comprise a conductive material, such as metal (e.g., copper) or other suitable conductive material. In addition, the groups of contacts 300, 304, and 308 may be electrically connected to a group of device contacts 324*a* on the surface 302 of the substrate 200 (e.g., through unillustrated conductive traces on the substrate 200). The device contacts 324*a* are also conductive and electrically connect with corresponding contacts of the port 108 of the network device 104. One or more other circuit components 328 (e.g., capacitors, resistors, inductors, and/or the like) may be mounted to the surface 302 of the substrate 200.

Figure 3B:
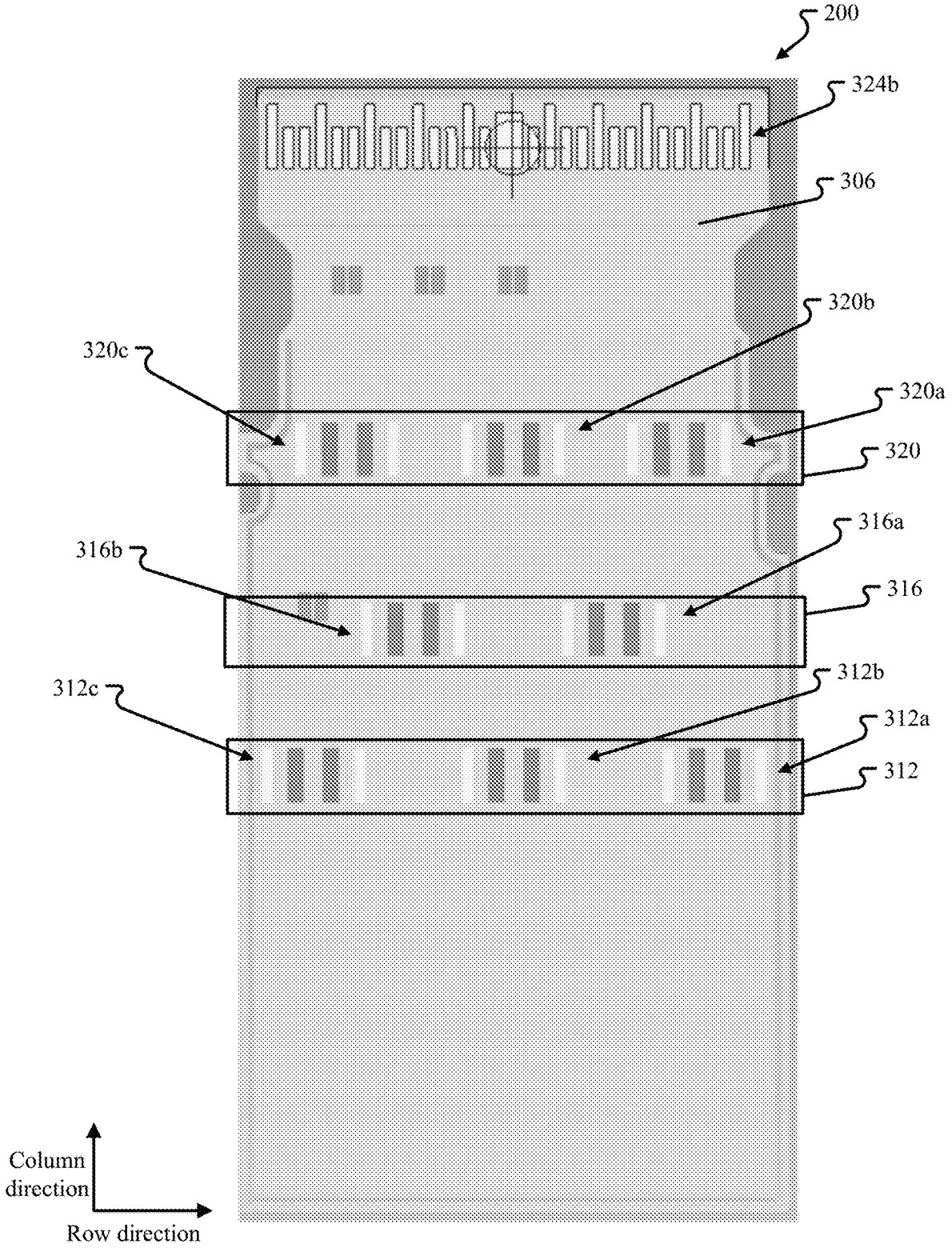

FIG. 3B illustrates a surface 306 of the substrate 200. The surface 306 and the surface 302 are opposite surfaces of the substrate 200. For example, surface 302 is a top surface of the substrate 200 and surface 306 is a bottom surface of the substrate 200.

The surface 306 includes groups of contacts 312, 316, and 320. Each group of contacts 312, 316, and 320 may include individual sets of contacts aligned with one another in a first direction (e.g., a row direction). For example, the group of contacts 312 is a row of contacts that includes a set of contacts 312*a*, a set of contacts 312*b*, and a set of contacts 312*c*. The group of contacts 316 is a row of contacts that includes a set of contacts 316*a* and a set of contacts 316*b*. The group of contacts 320 is a row of contacts that includes a set of contacts 320*a*, a set of contacts 320*b*, and a set of contacts 320*c*. Each set of contacts in each group of contacts may include a same number of contacts. In the example of FIG. 3A, each set of contacts includes four contacts. However, a number of contacts in each set of contacts may vary according to design preferences (e.g., according to the form factor for the cable assembly 124). As shown and described in more detail below, the group of contacts 312 and the group of contacts 320 are spaced apart from one another in a second direction (e.g., a column direction) that is substantially perpendicular to the first direction by an amount that allows cables connected to the group of contacts 320 to be stacked on the cables connected to the group of contacts 312.

Each contact in the groups of contacts 312, 316, and 320 may comprise a conductive material, such as metal (e.g., copper) or other suitable conductive material. In addition, the groups of contacts 312, 316, and 320 may be electrically connected to a group of device contacts 324*b* on the surface 302 of the substrate 200 (e.g., through unillustrated conductive traces on the substrate 200). The device contacts 324*b* are also conductive and electrically connect with corresponding contacts of the port 108 of the network device 104.

Figure 3C:
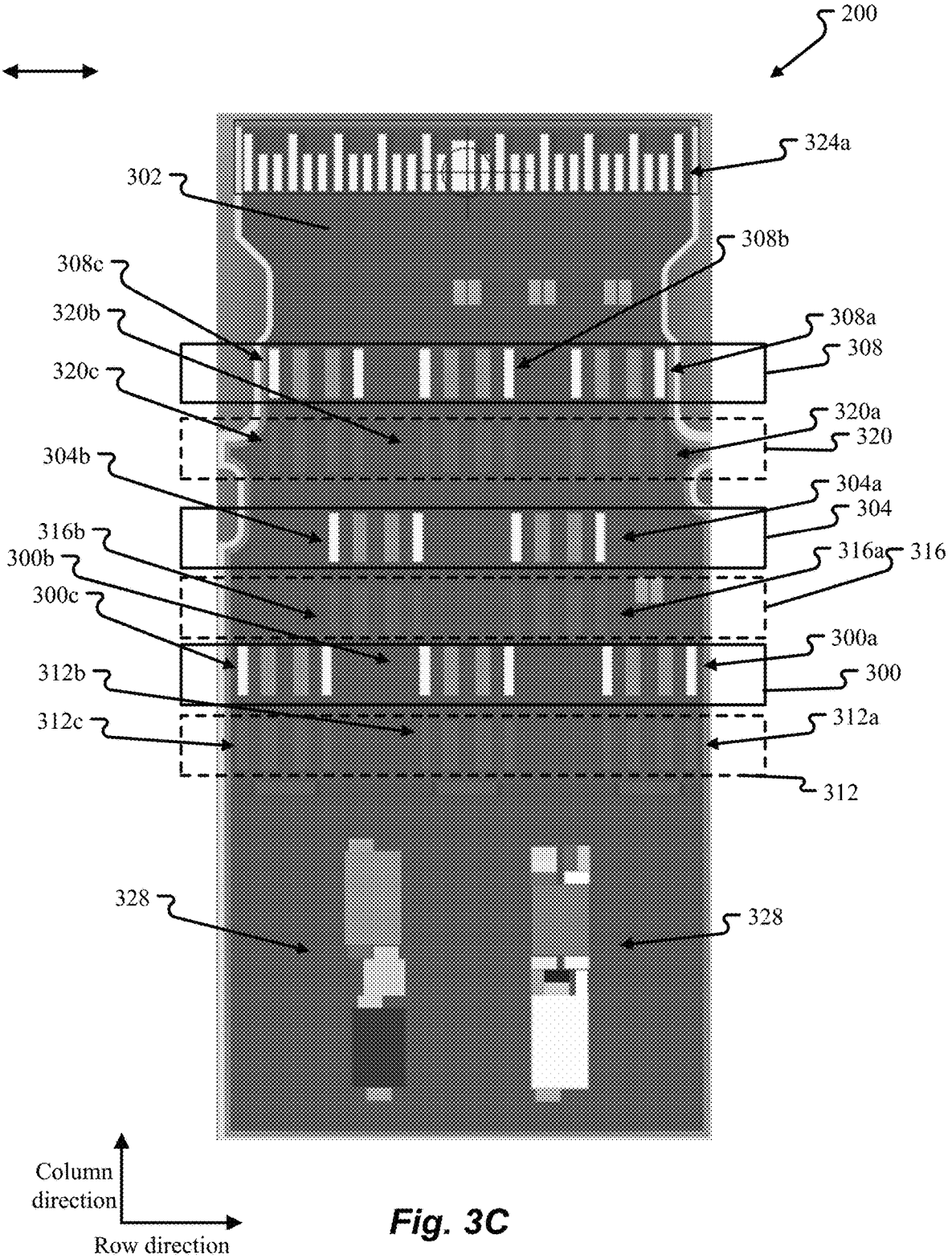

FIG. 3C illustrates the positions of the groups of contacts 300, 304, 308 on the surface 302 of the substrate 200 relative to the positions of the groups of contacts 312, 316, and 320 on the surface 306 of the substrate 200. FIG. 3D illustrates example spacings between the sets of contacts in each group of contacts 300, 304, 308, 312, 316, and 320.

As may be appreciated from FIGS. 3C and 3D, the groups of contacts 300, 304, and 308 are closer to the plurality of device contacts 324*a* and 324*b* than corresponding groups of contacts 312, 316, and 320. In other words, in a plan view, the group of contacts 300 is spaced apart from the group of contacts 312 in the second direction (e.g., the column direction), the group of contacts 304 is spaced apart from the group of contacts 316 in the second direction, and the group of contacts 308 is spaced apart from the group of contacts 320 in the second direction. However, example embodiments are not limited thereto, and the relative positions of the groups of contacts on each surface 302 and 306 may be reversed so that, in a plan view, groups of contacts 312, 316, and 320 are closer to the device contacts 324*a* and 324*b* than corresponding groups of contacts 300, 304, and 308.

As may be further appreciated from FIGS. 3C and 3D, sets of contacts within two different groups of contacts are aligned with one another in the second direction (e.g., the column direction). For example, each set of contacts 300*a*, 300*b*, and 300*c* is aligned with a corresponding set of contacts 312*a*, 312*b*, and 312*c* in the second direction, each set of contacts 304*a* and 304*b* is aligned with a corresponding set of contacts 316*a* and 316*b* in the second direction, and each set of contacts 308*a*, 308*b*, and 308*c* is aligned with a corresponding set of contacts 320*a*, 320, and 320*c* in the second direction.

With reference to FIG. 3D, each group of contacts 300, 304, and 308 are offset from one another the first direction (e.g., a row direction), and each group of contacts 312, 316, and 320 are offset from one another in the first direction. The sets of contacts in each group of contacts may be spaced apart from one another in the first direction by distances D1 and D2, where D1 is less than D2. In one example embodiment, distance D1 is about 2.30 mm and distance D2 is about 3.59 mm. Distances D1 and D2 correspond to the distances between a right edge of a rightmost contact in a set of contacts and a left edge of a leftmost contact in a neighboring set of contacts of the same group of contacts.

The sets of contacts in each group of contacts may be spaced apart from one another in the second direction (e.g., the column direction) by distances D3 and D4, where D3 is greater than D4. In one example embodiment, distance D3 is about 4.64 mm and distance D4 is about 3.42 mm. Distances D3 and D4 correspond to distances between a bottom edge of a contact in a set of contacts and a top edge of a contact in a set of contacts of a different group of contacts.

In the example of FIGS. 3A to 3D, each set of contacts includes four contacts: two middle contacts and two outer contacts. Each middle contact in each set of contacts may have a substantially same width and each outer contact in each set of contacts may have a substantially same width, where the widths are measured in the row direction. For example, each middle contact is about 0.60 mm wide and each outer contact is about 0.40 mm wide. The middle and outer contacts in each set of contacts may have a substantially same length measured in the column direction. In one example, the length of each contact is about 2.00 mm. Each set of middle contacts is spaced apart from one another in the row direction by a distance that is greater than a distance that corresponds to a space between a middle contact and an outer contact. For example, each set of middle contacts is spaced apart from one another by about 0.70 mm while a middle contact is spaced apart from an adjacent outer contact by about 0.55 mm.

As discussed in more detail below, the above-described arrangement and/or dimensions of contacts enables stacking of cables within housings 140 of connectors 128 and 132. For example, the set of contacts 300*a* is spaced apart from the set of contacts 308*a* by an amount that enables a cable that connects to the set of contacts 308*a* to be stacked on and pass over a cable that connects to the set of contacts 300*a*. FIG. 3D illustrates this amount as distance D5. Distance D5 may correspond to a minimum distance needed for enabling cable stacking within the housing 140 of a connector while still allowing electrical connection of leads of a cable to a respective set of contacts. In at least one example embodiment, distance D5 is about 10.06 mm.

The spacings/distances discussed above may be varied according to design preference (e.g., according to the form factor of the cable assembly 124). In addition, the spacings/distances discussed above may be varied to optimize signal integrity (e.g., by selecting spacings that reduce crosstalk between lanes and/or to achieve uniform end-to-end losses).

Figure 4A:
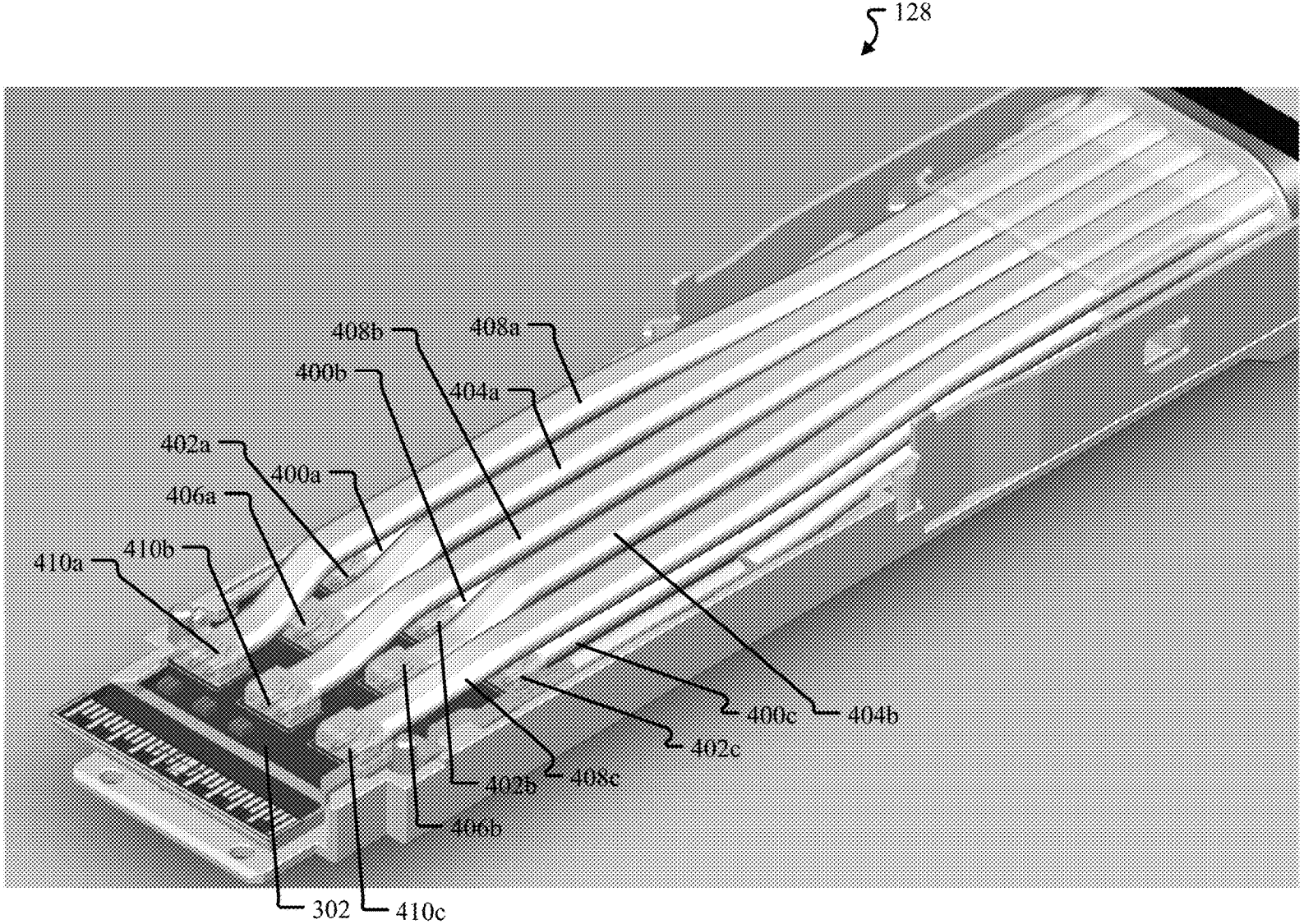
FIGS. 4A to 4D illustrate various top and bottom views of a connector from FIG. 2 to show an arrangement of cables that connect to a substrate according to at least one example embodiment.
Figure 4B:
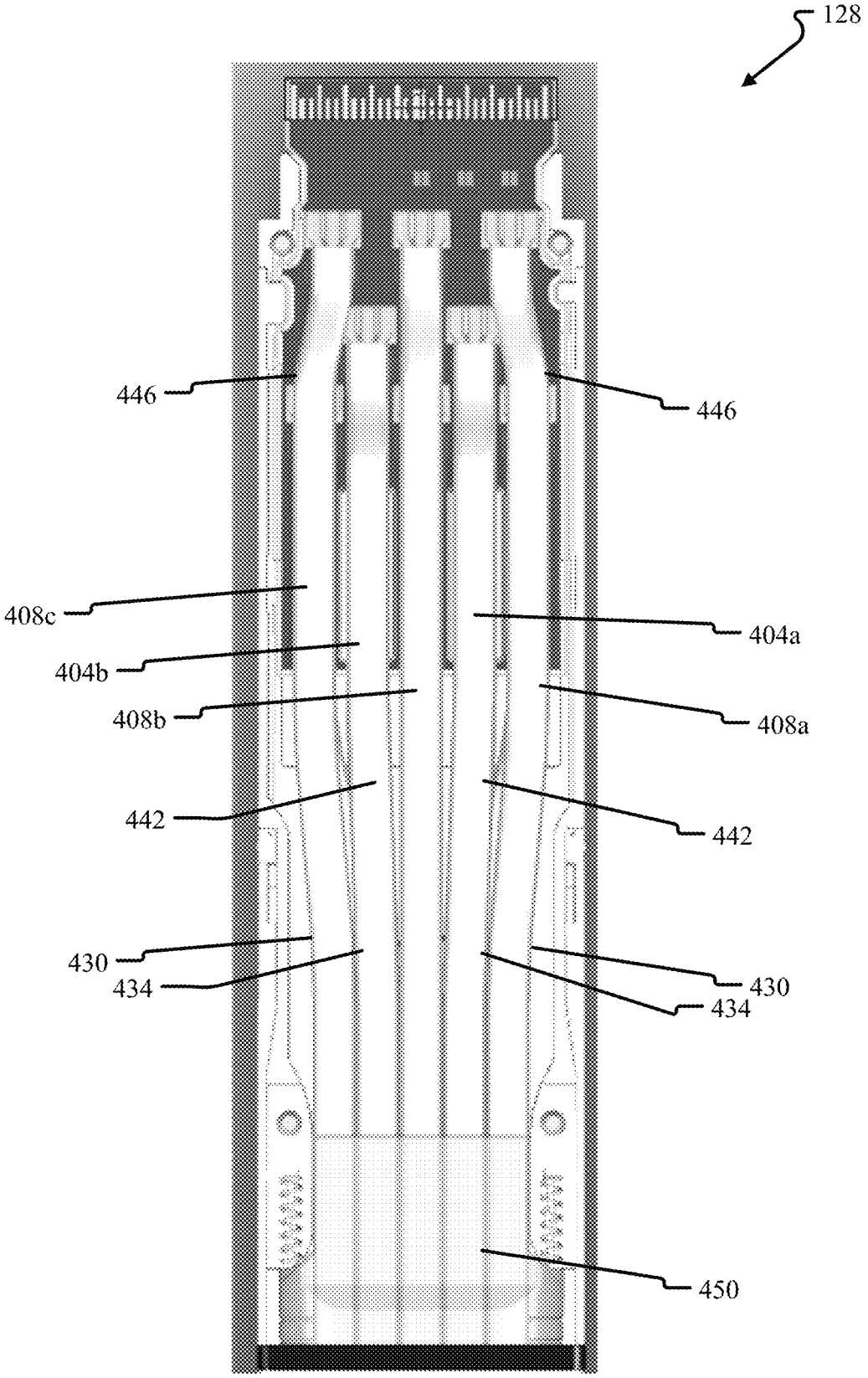
Figure 4C:
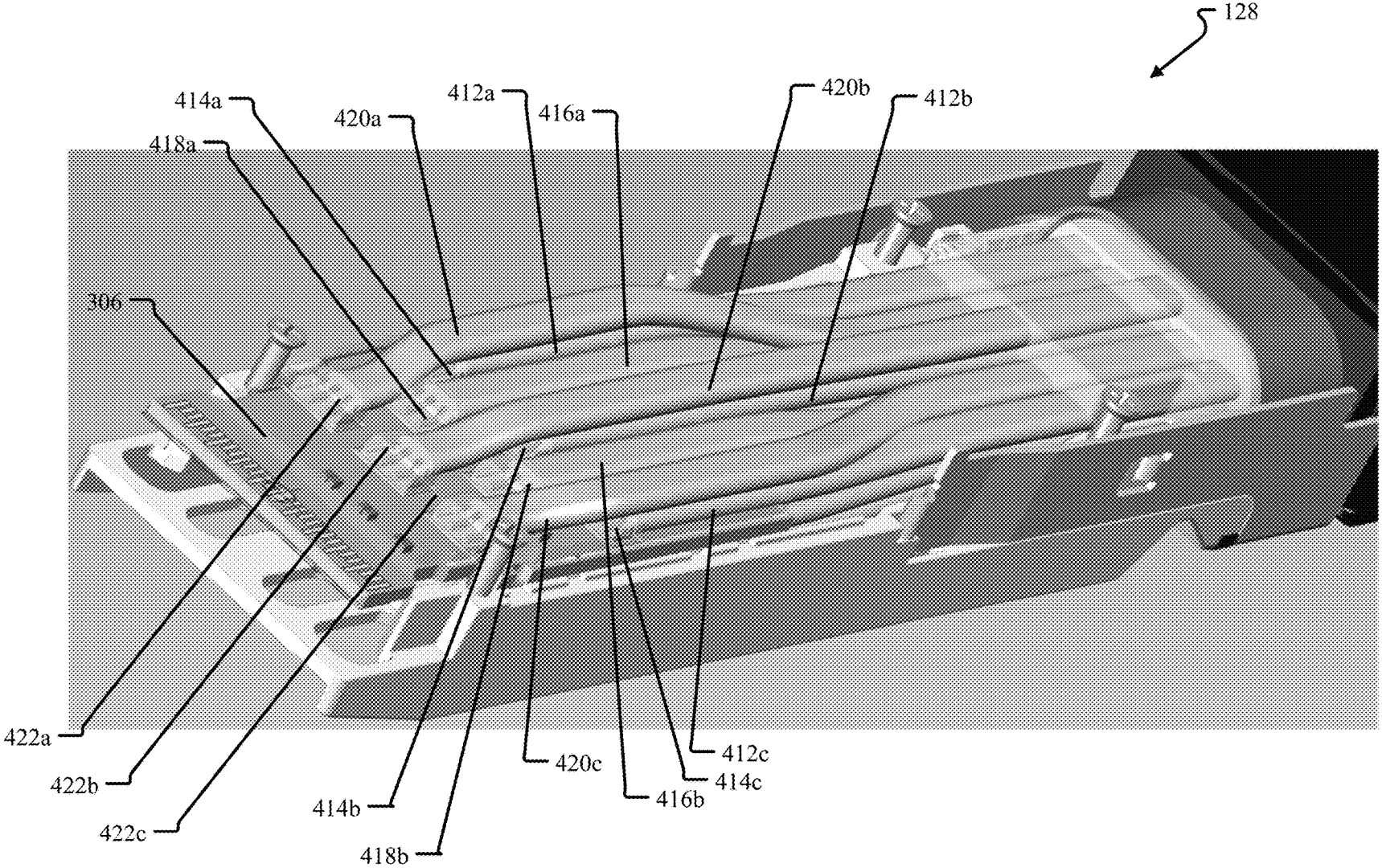
Figure 4D:
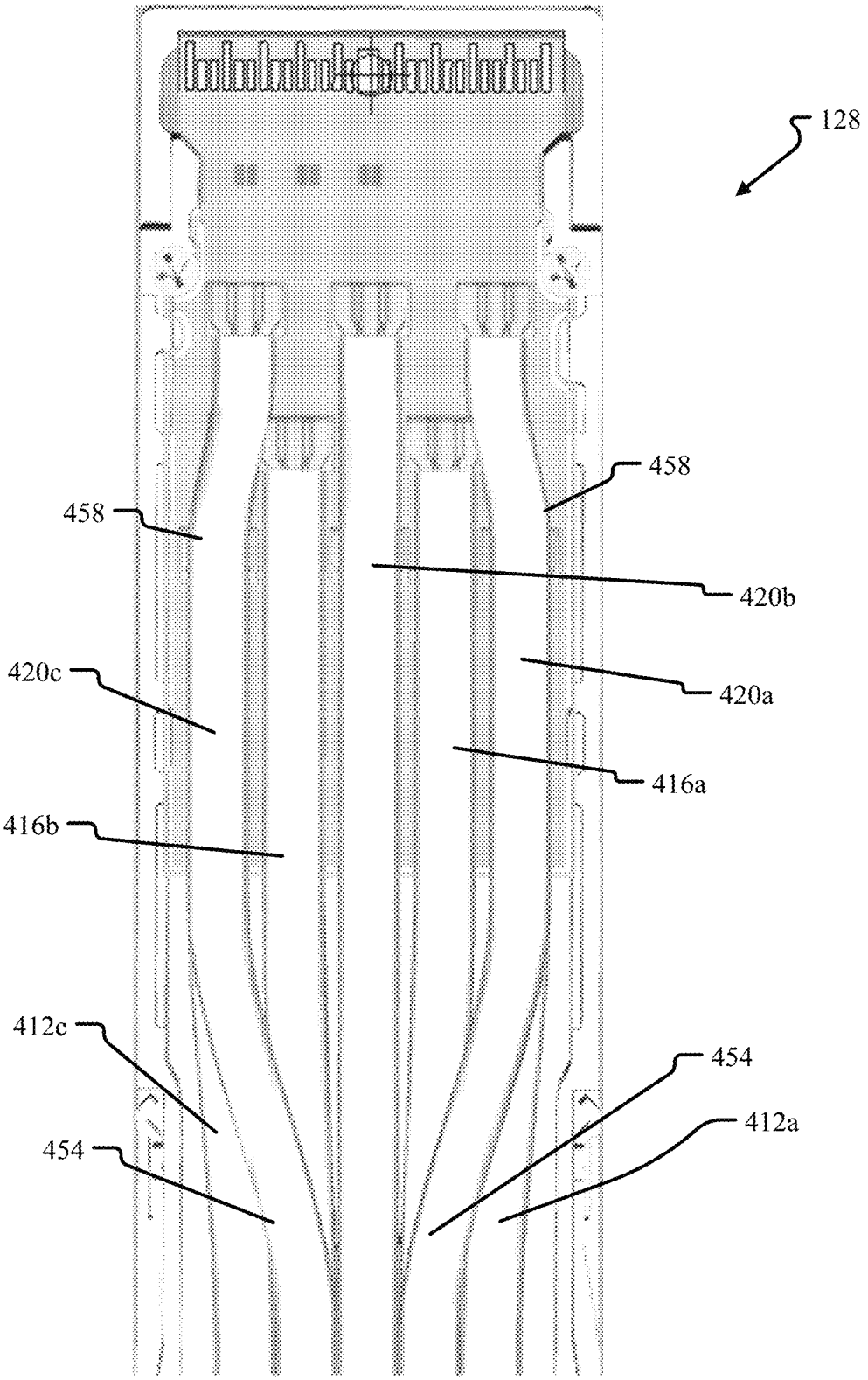

FIGS. 4A to 4D illustrates perspective views of a connector according to at least one example embodiment. In more detail, FIGS. 4A and 4B show views of how cables are routed and connected to a surface 302 of the substrate 200 while FIGS. 4C and 4D illustrate views of how cables are routed and connected to surface 306 of the substrate 200. As may be appreciated, portions of the housing 140 are hidden in FIGS. 4A to 4D to illustrate these details. FIGS. 4A to 4D are described with reference to connector 128, but the substantially same structure may be applied to connector 132.

FIG. 4A illustrates cables 400*a* to 408*c* connected to the groups of contacts 300, 304, and 308 on the surface 302 of the substrate 200. For example, leads of each cable are soldered to or otherwise brought into electrical contact with the contacts in the groups of contacts. FIG. 4A illustrates that each cable has four leads, but the number of leads may vary according to design preferences (e.g., according to the form factor for the cable assembly 124. As may be appreciated from FIG. 4A, cables 400*a*, 400*b*, and 400*c* are connected to a respective set of contacts 300*a*, 300*b*, and 300*c*, cables 404*a* and 404*b* are connected to a respective set of contacts 304*a* and 304*b*, and cables 408*a*, 408*b*, and 408*c* are connected to a respective set of contacts 308*a*, 308*b*, and 308*c*.

The arrangement and/or dimensions of contacts in FIGS. 3A to 3D enables stacking of cables within housings 140 of connectors 128 and 132. FIG. 4A illustrates three pairs of stacked cables attached to the surface 302: cables 400*a* and 408*a*, cables 400*b* and 408*b*, and cables 400*c* and 408*c*. For example, the set of contacts 300*a* is spaced apart from the set of contacts 308*a* by an amount that enables the cable 408*a* that connects to the set of contacts 308*a* to be stacked on and pass over the cable 400*a* that connects to the set of contacts 300*a*. The same is true for cables 400*b* and 408*b* and cables 400*c* and 408*c*. Meanwhile, cables 404*a* and 404*b* are not stacked on any other cables attached to the surface 302. For example, in a plan view, cable 404*a* is positioned between cable 408*a* and cable 408*b* while cable 404*b* is positioned between cable 408*b* and cable 408*c*.

The leads of each cable 400*a* to 408*c* may be encapsulated by a respective one of protective elements 402*a* to 410*c*. Each protective element 402*a* to 410*c* may comprise an encapsulation material, such as resin or suitable material for protecting the leads from moisture, electrical shorts, and the like. The protective elements 402*a* to 410*c* are illustrated as individual elements, but in at least one embodiment, the substantially same function of may be accomplished by encasing all of the leads and parts of the cables 400*a* to 408*c* in an encapsulation material effectively integrating the individual protective elements 402*a* to 410*c* into a single layer.

As illustrated in FIG. 4A, ends of cables 404*a*, 404*b* 408*a*, 408*b*, and 408*c* may be bent toward the surface 302 in order to electrically connect the leads of each cable to a corresponding set of contacts. The sections of cables 404*a*, 404*b* 408*a*, 408*b*, and 408*c* leading to the bent sections may exist on within a substantially same plane that allows each cable to pass over another element of the connector 128 (e.g., another cable in the case of cables 408*a*, 408*b*, and 408*c* or circuit components 328 in the case of cables 404*a* and 404*b*). Cables 400*a*, 400*b*, and 400*c* may exist in a substantially same plane that is closer to the surface 302 than the plane of the sections of cables 404*a*, 404*b* 408*a*, 408*b*, and 408*c*.

FIG. 4B illustrates a plan view of the cables to show how cables 408*a* and 408*c* have bends 430 that bend outwardly at a substantially same angle and how cables 404*a* and 404*b* have bends 434 that bend outwardly at a substantially same angle. The cables 408*a* and 408*c* then straighten while the cables 404*a* and 404*b* also straighten. As illustrated by bends 446, cables 408*a* and 408*c* bend inwardly at a substantially same angle before again straightening to connect to respective sets of contacts. As further shown, cable 408*a* passes over the set of contacts 300*a* and a portion of the set of contacts 304*a* (e.g., a rightmost contact) while cable 408*c* passes over the set of contacts 300*c* and a portion of the set of contacts 304*b* (e.g., a leftmost contact).

The cables 400*a* to 408*c* may be encapsulated by encapsulation material 450 (e.g., resin or the like) at one end of the connector 128 in order hold the cables 400*a* to 408*c* in place.

FIG. 4C illustrates cables 412*a* to 420*c* connected to the groups of contacts 400, 404, and 408 on the surface 306 of the substrate 200. For example, leads of each cable are soldered to or otherwise brought into electrical contact with the contacts in the groups of contacts. FIG. 4C illustrates that each cable has four leads, but the number of leads may vary according to design preferences (e.g., according to the form factor for the cable assembly 124. As may be appreciated from FIG. 4C, cables 412*a*, 412*b*, and 412*c* are connected to a respective set of contacts 312*a*, 312*b*, and 312*c*, cables 416*a* and 416*b* are connected to a respective set of contacts 316*a* and 316*b*, and cables 420*a*, 420*b*, and 420*c* are connected to a respective set of contacts 320*a*, 320*b*, and 302*c*.

The arrangement and/or dimensions of contacts in FIGS. 3A to 3D enables stacking of cables within housings 140 of connectors 128 and 132. FIG. 4B illustrates three pairs of stacked cables attached to the surface 306: cables 412*a* and 420*a*, cables 412*b* and 420*b*, and cables 412*c* and 420*c*. For example, the set of contacts 312*a* is spaced apart from the set of contacts 320*a* by an amount that enables the cable 420*a* that connects to the set of contacts 320*a* to be stacked on and pass over the cable 412*a* that connects to the set of contacts 312*a*. The same is true for cables 412*b* and 420*b* and cables 412*c* and 420*c*. Meanwhile, cables 416*a* and 416*b* are not stacked on any other cables attached to the surface 306. For example, in a plan view, cable 416*a* is positioned between cable 412*a* and cable 412*b* while cable 416*b* is positioned between cable 412*b* and cable 412*c*.

The leads of each cable 412*a* to 420*c* may be encapsulated by a respective one of protective elements 414*a* to 422*c*. Each protective element 414*a* to 422*c* may comprise an encapsulation material, such as resin or suitable material for protecting the leads from moisture, electrical shorts, and the like. The protective elements 414*a* to 422*c* are illustrated as individual elements, but in at least one embodiment, the substantially same function of may be accomplished by encasing all of the leads and parts of the cables 412*a* to 420*c* in an encapsulation material effectively integrating the individual protective elements 414*a* to 422*c* into a single layer.

As illustrated in FIG. 4A, ends of cables 420*a*, 20*b*, and 420*c* may be bent toward the surface 306 in order to electrically connect the leads of each cable to a corresponding set of contacts. The sections of cables 420*a*, 20*b*, and 420*c* leading to the bent sections may exist on within a substantially same plane that allows each cable to pass over another element of the connector 128 (e.g., another cable in the case of cables 420*a*, 20*b*, and 420*c*). Cables 412*a*, 412*b*, 412*c*, 416*a*, and 416*b* may exist in a substantially same plane that is closer to the surface 306 than the plane of the sections of cables 420*a*, 20*b*, and 420*c*.

FIG. 4D illustrates a plan view of the cables to show how cables 420*a* and 420*c* have bends 454 that bend outwardly at a substantially same angle and how cables 404*a* and 404*b* have bends 434 that bend outwardly at a substantially same angle. The cables 420*aa* and 420*c* then straighten. Thereafter, cables 420*a* and 420*c* bend inwardly at bends 458 at a substantially same angle before again straightening to connect to respective sets of contacts. As further shown, cable 420*a* passes over the set of contacts 312*a* and a portion of the set of contacts 316*a* (e.g., a rightmost contact) while cable 420*c* passes over the set of contacts 320*c* and a portion of the set of contacts 316*b* (e.g., a leftmost contact).

The cables 412*a* to 420*c* may be encapsulated by encapsulation material 450 (e.g., resin or the like) along with cables 400*a* to 408*c* at one end of the connector 128 in order hold all of the cables in place.

FIG. 5 illustrates various perspective cross-sectional views of a connector to show an example routing of cables as the cables approach the substrate 200 within the connector. In more detail, FIG. 5 illustrates four stages for routing the cables 400*a* to 420*c*, which progress from stage 500 to stage 512 through stages 504 and 508.

As shown in stage 500, the cables are initially arranged in a 3×5 stack with an extra cable 420*b* stacked on cable 412*b*. Stage 504, which illustrates a view that is closer to the substrate 200 than stage 500, shows how cables 420*a* and 420*c* begin to shift outward. For example, cable 420*a* is routed to begin to move under cable 412*a* while cable 420*c* is routed to begin to move under cable 412*c*. Meanwhile, in stage 504, some of the remaining cables begin to vertically separate in order to be arranged over respective surfaces 302 or 306 of the substrate 200.

Stage 508, which illustrates a view that is closer to the substrate 200 than stage 504, shows how the cable 420*a* forms a cable stack with cable 412*a* and how cable 420*c* forms a cable stack with cable 412*c*. Stage 508 further illustrates additional vertical separation for the remaining cables.

Finally, stage 512 shows the how the cables 400*a* to 420*c* arrive at final relative positions on the substrate 200. As shown, each surface 302 and 306 of the substrate 200 includes three stacked pairs of cables and one pair of non-stacked cables. At stage 512, it may be said that cables 408*a*, 404*a*, 408*b*, 404*b*, and 408*c* are in a substantially same plane while cables 400*a*, 400*b*, and 400*c* are in a substantially same plane that is closer to the surface 302 of the substrate 200. Similarly, cables 420*a*, 420, and 420*c* are in a substantially same plane while cables 412*a*, 416*a*, 412*b*, 416*b*, and 412*c* are in a substantially same plane that is closer to the surface 306 of the substrate 200.

FIG. 6 illustrates an end view of a connector to further illustrate various details of the cables from FIGS. 4A to 5.

In view of FIGS. 1 to 6, it should be appreciated that inventive concepts provide arrangements for soldering contacts and cables within a connector of a cable assembly that may improve signal integrity while being compatible with existing (or future) form factors. For example, inventive concepts provide end to end loss uniformity between lanes of the cable assembly in that the contacts in each group of contacts are aligned with one another in a row direction, thus making any losses substantially predicable and uniform. In addition, the spacing between sets of contacts in each row of contacts and the spacing between sets of contacts in different rows of contacts may allow for cross talk reduction and/or mitigation. For example, the cables that pass between stacked pairs of cables (e.g., cables 404*a*, 404*b*, 416*a*, and 416*b*) may contribute to cross talk reduction.

Although example embodiments show stacking a maximum of two cables on a surface of a substrate, inventive concepts may be expanded to include stacking more cables if, for example, allowed by the form factor selected for the cable assembly.

In view of FIGS. 1-6, example embodiments are directed to a connector (e.g., connector 128 and/or connector 136) for a networking cable assembly 124. The connector includes a substrate 200, a first set of contacts 300*a* on a first surface 302 of the substrate 200 and that electrically connect to leads of a first cable 400*a*, and a second set of contacts 408*a* on the first surface 302 of the substrate 200 and that electrically connect to leads of a second cable 408*a*. The first set of contacts 300*a* are spaced apart from the second set of contacts 308*a* in a column direction by an amount that enables the second cable 408*a* to be stacked on the first cable 400*a* and passed over the first set of contacts 300*a* to electrically connect to the leads of the second cable 408*a*.

The connector may further comprise a third set of contacts 304*a* on the first surface 302 of the substrate 200 that electrically connect to leads of a third cable 404*a*. The first set of contacts 300*a*, the second set of contacts 308*a*, and the third set of contacts 304*a* each include a same number of contacts. The third set of contacts 304*a* is between the first set of contacts 300*a* and the second set of contacts 308*a*. For example, the first set of contacts 300*a* is part of a first row of contacts 308 and the second set of contacts 3078*a* is part of a second row of contacts 308. As shown in FIG. 3A, the first row of contacts 300 and the second row of contacts 308 each include two additional sets of contacts 300*b*, 300*c* and 308*b*, 308*c* that electrically connect to respective leads of two additional cables 400*b*, 400*c* and 420*b* and 420*c*. The third set of contacts 304*a* is part of a third row of contacts 304 that includes one additional set of contacts 304*b* that electrically connect to leads of one additional cable 404*b*. The third set of contacts 304*b* is offset from the first set of contacts 300*a* in a row direction substantially perpendicular to the column direction by an amount that enables the second cable 408*a* to pass over part of the third set of contacts 404*a* to electrically connect the leads of the second cable 408*a* to the second set of contacts 308*a*.

As shown in FIGS. 3B-3D, the connector may include a third set of contacts 312*a* on a second surface 306 of the substrate 200 and that electrically connect to leads of a third cable 412*a*. The second surface 306 of the substrate 200 is opposite the first surface 302 of the substrate 200. The connector may further comprise a fourth set of contacts 320*a* on the second surface 306 of the substrate 200 that electrically connect to leads of a fourth cable 420*a*. Here, the third set of contacts 312*a* are spaced apart from the fourth set of contacts 320*a* in the column direction by an amount that enables the fourth cable 420*a* to be stacked on the third cable 412*a* and passed over the third set of contacts 312*a* to electrically connect to the leads of the third cable 412*a*. The connector may further comprise a fifth set of contacts 316*a* on the second surface 306 of the substrate 200 that electrically connect to leads of a fifth cable 416*a*. The first set of contacts 300*a*, the second set of contacts 308*a*, the third set of contacts 312*a*, the fourth set of contacts 320*a*, and the fifth set of contacts 316*a* each include a same number of contacts. The fifth set of contacts 316*a* is between the third set of contacts 312*a* and the fourth set of contacts 320*a*.

In one embodiment, the first set of contacts 300*a* are aligned with one another in the row direction substantially perpendicular to the column direction, and the second set of contacts 308*a* are aligned with one another in the row direction. In addition, the first and second sets of contacts 300*a* and 308*a* include linear shaped contacts that extend in the column direction.

The connector may further comprise a housing 140 that houses the substrate 200 and covers the first set of contacts 300*a*, the second set of contacts 308*a*, the first cable 400*a*, and the second cable 408*a*. One end of the substrate 200 further comprises a plurality of device contacts 324 that electrically connect to an external device (e.g., to port 108 or port 120 of network devices 104 and 116) and to the first set of contacts 300*a* and the second set of contacts 308*a*.

At least one example embodiment is directed to a printed circuit board (PCB) for a networking cable assembly 124. The PCB (e.g., substrate 200) includes a first group of contacts 300 on a first surface 302 of the PCB, and the first group of contacts 300 are aligned with one another in a row direction. The PCB includes a second group of contacts 304 on the first surface 302 of the PCB, and the second group of contacts 304 are aligned with one another in the row direction and spaced apart from the first group of contacts 300 in a column direction substantially perpendicular to the row direction. The PCB includes a third group of contacts 308 on the first surface 302 of the PCB, and the third group of contacts 308 are aligned with one another and spaced apart from the second group of contacts 304 in the column direction.

In one embodiment, the first group of contacts 300 includes three sets of contacts 300*a*, 300*b*, and 300*c* that electrically connect to leads of three cables 400*a*, 400*b*, and 400*c*, respectively. The second group of contacts 304 includes two sets of contacts 304*a* and 304*b* that electrically connect to leads of two cables 404*a* and 404*b*, respectively. The third group of contacts 308 includes three sets of contacts 308*a*, 308*b*, and 308*c* that electrically connect to leads of three cables 408*a*, 408*b*, and 408*c*, respectively. The second group of contacts 304 is between the first group of contacts 300 and the third group of contacts 308. Each of the first, second, and third group of contacts 300, 304, and 308 includes a same number of contacts.

At least one example embodiment is directed to a cable assembly 124 that includes a printed circuit board (PCB) (e.g., substrate 200). The PCB comprises a first set of contacts 300*a* aligned with one another in a row direction and a second set of contacts 308*a* that are aligned with one another in the row direction and spaced apart from the first set of contacts 300*a* in a column direction substantially perpendicular to the row direction, The cable assembly 124 includes a first cable 300*a* including leads electrically connected to the first set of contacts 300*a* and a second cable 408*a* stacked on the first cable 400*a* and passing over the first set of contacts 300*a* to electrically connect leads of the second cable 408*a* to the second set of contacts 308*a*. The cable assembly 124 further includes a housing 140 that houses the PCB.

Specific details were given in the description to provide a thorough understanding of the embodiments. However, it will be understood by one of ordinary skill in the art that the embodiments may be practiced without these specific details. In other instances, well-known circuits, processes, algorithms, structures, and techniques may be shown without unnecessary detail in order to avoid obscuring the embodiments.

While illustrative embodiments of the disclosure have been described in detail herein, it is to be understood that the inventive concepts may be otherwise variously embodied and employed, and that the appended claims are intended to be construed to include such variations, except as limited by the prior art.

It should be appreciated that inventive concepts cover any embodiment in combination with any one or more other embodiment, any one or more of the features disclosed herein, any one or more of the features as substantially disclosed herein, any one or more of the features as substantially disclosed herein in combination with any one or more other features as substantially disclosed herein, any one of the aspects/features/embodiments in combination with any one or more other aspects/features/embodiments, use of any one or more of the embodiments or features as disclosed herein. It is to be appreciated that any feature described herein can be claimed in combination with any other feature(s) as described herein, regardless of whether the features come from the same described embodiment.

Example embodiments may be configured as follows:

(1) A connector for a networking cable assembly, the device comprising:

a substrate;

a first set of contacts on a first surface of the substrate and that electrically connect to leads of a first cable; and a second set of contacts on the first surface of the substrate and that electrically connect to leads of a second cable, the first set of contacts being spaced apart from the second set of contacts in a first direction by an amount that enables the second cable to be stacked on the first cable and passed over the first set of contacts to electrically connect to the leads of the second cable.

(2) The connector of (1), further comprising:

a third set of contacts on the first surface of the substrate and that electrically connect to leads of a third cable.

(3) The connector of one or more of (1) to (2), wherein the first set of contacts, the second set of contacts, and the third set of contacts each include a same number of contacts.

(4) The connector of one or more of (1) to (3), wherein the third set of contacts is between the first set of contacts and the second set of contacts.

(5) The connector of one or more of (1) to (4), wherein the first set of contacts is part of a first row of contacts and the second set of contacts is part of a second row of contacts, and wherein the first row of contacts and the second row of contacts each include two additional sets of contacts that electrically connect to respective leads of two additional cables.

(6) The connector of one or more of (1) to (5), wherein the third set of contacts is part of a third row of contacts that includes one additional set of contacts that electrically connect to leads of one additional cable.

(7) The connector of one or more of (1) to (6), wherein the third set of contacts is offset from the first set of contacts in a second direction substantially perpendicular to the first direction by an amount that enables the second cable to pass over part of the third set of contacts to electrically connect the leads of the second cable to the second set of contacts.

(8) The connector of one or more of (1) to (7), further comprising:

a third set of contacts on a second surface of the substrate and that electrically connect to leads of a third cable, the second surface of the substrate being opposite the first surface of the substrate; and a fourth set of contacts on the second surface of the substrate and that electrically connect to leads of a fourth cable, the third set of contacts being spaced apart from the fourth set of contacts in the first direction by an amount that enables the fourth cable to be stacked on the third cable and passed over the third set of contacts to electrically connect to the leads of the third cable.

(9) The connector of one or more of (1) to (8), further comprising:

a fifth set of contacts on the second surface of the substrate and that electrically connect to leads of a fifth cable.

(10) The connector of one or more of (1) to (9), wherein the first set of contacts, the second set of contacts, the third set of contacts, the fourth set of contacts, and the fifth set of contacts each include a same number of contacts.

(11) The connector of one or more of (1) to (10), wherein the fifth set of contacts is between the third set of contacts and the fourth set of contacts.

(12) The connector of one or more of (1) to (11), wherein the first set of contacts are aligned with one another in a second direction substantially perpendicular to the first direction, and wherein the second set of contacts are aligned with one another in the second direction.

(13) The connector of one or more of (1) to (12), wherein the first and second sets of contacts are linear shaped contacts that extend in the first direction.

(14) The connector of one or more of (1) to (13), further comprising:

a housing that houses the substrate and covers the first set of contacts, the second set of contacts, the first cable, and the second cable.

(15) The connector of one or more of (1) to (14), wherein one end of the substrate further comprises a plurality of device contacts that electrically connect to an external device and to the first set of contacts and the second set of contacts.

(16) A printed circuit board (PCB) for a networking cable assembly, comprising:

a first group of contacts on a first surface of the PCB, the first group of contacts being aligned with one another in a first direction;

a second group of contacts on the first surface of the PCB, the second group of contacts being aligned with one another in the first direction and spaced apart from the first group of contacts in a second direction substantially perpendicular to the first direction; and a third group of contacts on the first surface of the PCB, the third group of contacts being aligned with one another and spaced apart from the second group of contacts in the second direction.

(17) The PCB of claim 16, wherein the first group of contacts includes three sets of contacts that electrically connect to leads of three cables, respectively, wherein the second group of contacts includes two sets of contacts that electrically connect to leads of two cables, respectively, and wherein the third group of contacts includes three sets of contacts that electrically connect to leads of three cables, respectively.

(18) The PCB of claim 17, wherein the second group of contacts is between the first group of contacts and the third group of contacts.

(19) The PCB of claim 18, wherein each of the first, second, and third groups of contacts includes a same number of contacts.

(20) A networking cable assembly, comprising:

a printed circuit board (PCB) including:

a first set of contacts aligned with one another in a first direction; and a second set of contacts that are aligned with one another in the first direction and spaced apart from the first set of contacts in a second direction substantially perpendicular to the first direction;

a first cable including leads electrically connected to the first set of contacts;

a second cable stacked on the first cable and passing over the first set of contacts to electrically connect leads of the second cable to the second set of contacts; and a housing that houses the PCB.

What is claimed is:

1. A connector for a networking cable assembly, the connector comprising: a substrate; a first set of contacts on a first surface of the substrate and that electrically connect to leads of a first cable; and a second set of contacts on the first surface of the substrate and that electrically connect to leads of a second cable, the first set of contacts being spaced apart from the second set of contacts in a first direction by an amount that enables the second cable to be stacked on the first cable and passed over the first set of contacts to electrically connect to the leads of the second cable; and a third set of contacts on the first surface of the substrate and that electrically connect to leads of a third cable, wherein the first set of contacts is part of a first row of contacts that has exactly three sets of contacts that electrically connect to leads of three respective cables including the leads of the first cable, the second set of contacts is part of a second row of contacts that has exactly three sets of contacts that electrically connect to leads of three respective cables including the leads of the second cable, and the third set of contacts is part of a third row of contacts that has exactly two sets of contacts that electrically connect to leads of two respective cables including the leads of the third cable, and wherein the third row of contacts is between the first row of contacts and the second row of contacts in the first direction.

2. The connector of claim 1, wherein the first row of contacts includes a first contact closest to an edge of the substrate, wherein the second row of contacts includes a second contact closest to the edge of the substrate, and wherein the first contact is offset from the second contact in a direction toward a center of the substrate.

3. The connector of claim 2, wherein the first set of contacts, the second set of contacts, and the third set of contacts each include a same number of contacts.

4. The connector of claim 1, further comprising:

a fourth row of contacts on a second surface of the substrate opposite the first surface and that electrically connect to leads of respective cables, wherein, in a plan view, the fourth row of contacts is offset in the first direction from a first side of the third row of contacts.

5. The connector of claim 4, further comprising:

a fifth row of contacts on the second surface of the substrate that electrically connect to leads of respective cables, wherein, in the plan view, the fifth row of contacts are offset in the first direction from a second side of the third row of contacts opposite the first side.

6. The connector of claim 5, further comprising:

a sixth row of contacts on the second surface of the substrate that electrically connect to leads of respective cables, wherein, in the plan view, the fifth row of contacts is offset in the first direction from a first side of the first row of contacts.

7. The connector of claim 4, wherein the third set of contacts is offset from the first set of contacts in a second direction substantially perpendicular to the first direction by an amount that enables the second cable to pass over part of the third set of contacts to electrically connect the leads of the second cable to the second set of contacts.

8. The connector of claim 1, further comprising:

a fourth set of contacts on a second surface of the substrate and that electrically connect to leads of a fourth cable, the second surface of the substrate being opposite the first surface of the substrate; and a fifth set of contacts on the second surface of the substrate and that electrically connect to leads of a fifth cable, the fourth set of contacts being spaced apart from the fifth set of contacts in the first direction by an amount that enables the fifth cable to be stacked on the fourth cable and passed over the fourth set of contacts to electrically connect to the leads of the fourth cable.

9. The connector of claim 8, further comprising:

a sixth set of contacts on the second surface of the substrate and that electrically connect to leads of a sixth cable.

10. The connector of claim 9, wherein the first set of contacts, the second set of contacts, the third set of contacts, the fourth set of contacts, the fifth set of contacts, and the sixth set of contacts each include a same number of contacts.

11. The connector of claim 9, wherein the sixth set of contacts is between the fourth set of contacts and the fifth set of contacts in the first direction.

12. The connector of claim 1, wherein the first set of contacts are aligned with one another in a second direction substantially perpendicular to the first direction, and wherein the second set of contacts are aligned with one another in the second direction.

13. The connector of claim 12, wherein the first and second sets of contacts are linear shaped contacts that extend in the first direction.

14. The connector of claim 1, further comprising:

a housing that houses the substrate and covers the first set of contacts, the second set of contacts, the first cable, and the second cable.

15. The connector of claim 14, wherein one end of the substrate further comprises a plurality of device contacts that electrically connect to an external device and to the first set of contacts and the second set of contacts.

16. A printed circuit board (PCB) for a networking cable assembly, comprising:

a first group of contacts on a first surface of the PCB, the first group of contacts being aligned with one another in a first direction;

a second group of contacts on the first surface of the PCB, the second group of contacts being aligned with one another in the first direction and spaced apart from the first group of contacts in a second direction substantially perpendicular to the first direction; and a third group of contacts on the first surface of the PCB, the third group of contacts being aligned with one another and spaced apart from the second group of contacts in the second direction, wherein, along the second direction, the second group of contacts is between the first group of contacts and the third group of contacts, and wherein the first group of contacts is three sets of contacts that electrically connect to three cables, respectively, the second group of contacts is two sets of contacts that electrically connect to two cables, respectively, and the third group of contacts is three sets of contacts that electrically connect to three cables, respectively.

17. The PCB of claim 16, wherein, in a plan view, a longitudinal axis of a contact in the second group of contacts does not intersect any contacts in the first, second, and third group of contacts.

18. The PCB of claim 17, wherein, in the plan view, the three sets of contacts in the first group of contacts includes a first contact closest to an edge of the PCB, wherein the three sets of contacts in the third group of contacts includes a second contact closest to the edge of the PCB, and wherein the first contact is offset from the second contact in a direction toward a center of the PCB.

19. The PCB of claim 18, wherein each of the first and third groups of contacts includes a same number of contacts.

20. A networking cable assembly, comprising:

a printed circuit board (PCB) including:

a first set of contacts aligned with one another in a first direction;

a second set of contacts that are aligned with one another in the first direction and spaced apart from the first set of contacts in a second direction substantially perpendicular to the first direction; and a third set of contacts aligned with one another in the first direction;

a first cable including leads electrically connected to the first set of contacts;

a second cable stacked on the first cable and passing over the first set of contacts to electrically connect leads of the second cable to the second set of contacts;

a third cable including leads electrically connected to the third set of contacts; and a housing that houses the PCB, wherein the first set of contacts is part of a first row of contacts that has exactly three sets of contacts that electrically connect to leads of a first number of cables, the second set of contacts is part of a second row of contacts that has exactly three sets of contacts that electrically connect to leads of a second number of cables, and the third set of contacts is part of a third row of contacts that has exactly two sets of contacts that electrically connect to leads of a third number of cables, wherein the third row of contacts is between the first row of contacts and the second row of contacts in the first direction, and wherein the third number of cables is fewer than the first number of cables and the second number of cables.

* * * * *